US009527663B2

(12) United States Patent
Rivola

(10) Patent No.: US 9,527,663 B2
(45) Date of Patent: Dec. 27, 2016

(54) MACHINE FOR MAKING FILTER BAGS FOR INFUSION PRODUCTS

(71) Applicant: IMA INDUSTRIES S.R.L., Ozzano Emilia (IT)

(72) Inventor: Sauro Rivola, Riolo Terme (IT)

(73) Assignee: I.M.A. INDUSTRIA MACCHINE AUTOMATICHE S.P.A., Ozzano Dell'Emilia (IT)

( * ) Notice: Subject to any disclaimer, the term of this patent is extended or adjusted under 35 U.S.C. 154(b) by 0 days.

(21) Appl. No.: 14/441,927

(22) PCT Filed: Dec. 19, 2013

(86) PCT No.: PCT/IB2013/061133
§ 371 (c)(1),
(2) Date: May 11, 2015

(87) PCT Pub. No.: WO2014/097206
PCT Pub. Date: Jun. 26, 2014

(65) Prior Publication Data

US 2015/0291347 A1 Oct. 15, 2015

(30) Foreign Application Priority Data

Dec. 21, 2012 (IT) ..... BO2012A0706

(51) Int. Cl.
*B65B 9/04* (2006.01)
*B65D 85/808* (2006.01)
(Continued)

(52) U.S. Cl.
CPC ..... *B65D 85/808* (2013.01); *B65B 1/02* (2013.01); *B65B 1/04* (2013.01); *B65B 7/02* (2013.01);
(Continued)

(58) Field of Classification Search
CPC ..... B65B 9/04; B65B 9/042; B65B 29/02
(Continued)

(56) References Cited

U.S. PATENT DOCUMENTS 1,581,578 A * 4/1926 Kieselbach ..... B65D 85/808 426/77
3,597,222 A * 8/1971 Kalemba ..... B65D 85/808 426/79
(Continued)

FOREIGN PATENT DOCUMENTS

EP 1549548 A1 7/2005
WO 9501907 A2 1/1995
(Continued)

*Primary Examiner* — Gloria R Weeks
(74) *Attorney, Agent, or Firm* — Pearne & Gordon LLP

(57) ABSTRACT

A machine (100) for making filter bags (1) for infusion products comprises: a station (2) for feeding a first continuous strip (3) of thermoformable filter material; a station (4) for heating the first continuous strip (3); a continuously rotating drum (5) provided with a series of dies (9), and a corresponding series of punches (10) configured for plastically deforming a portion of the first strip (3) and making a three-dimensional chamber (C) to contain a dose (12) of infusion product; a station (11) for dosing doses (12) of the infusion product; a feed station (13) for feeding a second strip (14) of filter material; a joining station (15) for joining the first strip (3) to the second strip (14) to close the three-dimensional chamber (C); and a cutting station for making single filter bags (1).

5 Claims, 5 Drawing Sheets

(51) Int. Cl.

| | |
|---|---|
| ***B65B 29/02*** | (2006.01) |
| ***B65B 61/08*** | (2006.01) |
| ***B65B 1/02*** | (2006.01) |
| ***B65B 1/04*** | (2006.01) |
| ***B65B 7/02*** | (2006.01) |
| ***B65B 61/06*** | (2006.01) |

(52) U.S. Cl.
CPC ..... *B65B 9/042* (2013.01); *B65B 29/02* (2013.01); *B65B 61/06* (2013.01); *B65B 61/08* (2013.01)

(58) Field of Classification Search
USPC ..... 53/559
See application file for complete search history.

(56) References Cited

U.S. PATENT DOCUMENTS 3,925,959 A * 12/1975 Dykes ..... B65D 75/50 53/446
4,064,662 A * 12/1977 O'Toole ..... E04B 1/34357 135/115
4,081,305 A * 3/1978 Patin ..... B65H 45/20 156/181
4,216,639 A * 8/1980 Gautier ..... B31B 23/00 426/410
4,290,521 A * 9/1981 Mitchell ..... B65D 85/808 206/0.5
4,375,146 A * 3/1983 Chung ..... B65B 9/042 53/453
4,404,787 A * 9/1983 Hazelwood ..... B65B 1/366 53/502
4,437,294 A * 3/1984 Romagnoli ..... B65B 1/366 222/332
4,551,336 A * 11/1985 Chen ..... B65D 85/808 206/0.5
5,548,947 A 8/1996 Fincham et al.
6,571,537 B2 * 6/2003 Ghirlandi ..... B65B 57/10 53/134.2
7,188,458 B2 3/2007 Rea et al.
7,392,636 B2 * 7/2008 Conti ..... B65B 29/02 53/433
7,546,721 B2 * 6/2009 Rasile ..... B65B 9/20 493/189
7,559,185 B2 * 7/2009 Conti ..... B65B 9/04 53/453
8,590,279 B2 * 11/2013 Van Den Elzen ..... B65B 9/045 53/453
9,352,859 B2 * 5/2016 Librio ..... B65B 1/366
2003/0131565 A1 * 7/2003 Romagnoli ..... B65D 85/812 53/413
2004/0261370 A1 12/2004 Rea et al.
2008/0314003 A1 * 12/2008 Goglio ..... B65B 11/50 53/558
2009/0241468 A1 * 10/2009 Bernardi ..... B65B 35/20 53/77
2011/0047937 A1 * 3/2011 Tsuji ..... B29C 66/4312 53/413
2013/0133292 A1 5/2013 Ford et al.
2014/0048979 A1 2/2014 Woodward
2015/0336691 A1 * 11/2015 Fowler ..... B29C 51/20 206/524.7
2016/0008177 A1 * 1/2016 Schmitt ..... A61F 13/00072 53/433
2016/0251148 A1 * 9/2016 Edwards ..... B65B 3/022

FOREIGN PATENT DOCUMENTS

WO 2012004169 A2 1/2012
WO 2012150109 A1 11/2012

* cited by examiner

MACHINE FOR MAKING FILTER BAGS FOR INFUSION PRODUCTS

TECHNICAL FIELD

This invention relates to a machine for making filter bags for infusion products, such as, for example, tea or chamomile, in powder, granular or leaf form.

More specifically, the invention relates to a machine for making thermoformed filter bags for infusion products.

This invention also relates to a filter bag for infusion products, such as tea or chamomile, in powder, granular or leaf form.

BACKGROUND ART

Traditional filter bags (or tea bags), are generally formed from one or more lengths of filter material which are suitably folded and joined to make one or more chambers, each containing a dose of product intended for infusion in liquid (water).

The filter bag thus formed may be combined with a string which is joined at one end to the filter bag and at the other end to a tag, used to handle the filter bag during infusion.

This "traditional" type of filter bag, with its flat configuration, is extremely practical because it is relatively easy to make in current machines and also quick and easy to package.

On the contrary, their shape (substantially flat) makes filter bags of this kind unsuitable for containing infusion products of different, coarse-sized kinds, such as granules and leaves, which need a different containment chamber, that is to say, a larger chamber with more space for infusion to allow the passage of a larger amount of liquid and thus to obtain a better quality infusion.

For this reason, tea bags or filter bags having a three-dimensional shape, in particular a tetrahedral shape, have been devised and made.

The three-dimensional configuration makes these filter bags not only attractive but also functional because they are easy to handle for infusion and have a large chamber where the product can come into contact with the liquid.

These advantages of the three-dimensional configuration of the filter bag are counterbalanced by some disadvantages, however.

One disadvantage is due to the complexity of making a three-dimensional filter bag from a traditional strip of filter material (visible also in patent document EP 1.549.548 in the name of the same Applicant as this invention).

In light of this, the three-dimensional filter bag is made by a machine which, essentially, feeds a continuous strip of filter material.

A first sealing station closes the continuous strip onto itself and makes a first longitudinal seal to form a continuous tubular strip.

Next, a second station makes a sequence of second seals, transversal to the first seal, on the tubular strip to define successive flat filter bag perimeters.

After that, a tubular strip cutting station cuts the tubular strip at the transversal seals to obtain a sequence of partly formed filter bags, each having a closed (sealed) bottom end and an open, unsealed top end.

The machine comprises an opening station for opening out the unsealed end of each filter bag and an infusion product dosing station which places a dose of infusion product into the open mouth of the filter bag.

A further third sealing station makes a third seal by which the still open top end of each filter bag is closed.

It should be noted that the third closing seal extends transversely to both the first longitudinal seal and to the second transversal (ST) in order to obtain a three-dimensional, tetrahedral shape.

As may be noted, therefore, the process of forming the filter bag requires three seals, even on top of one another, to form, in a plane, a sort of H shape lying on edge, but angularly offset from each other in space.

As a result, the filter bag may not be properly sealed because the filter material may be damaged by the sequence of thermal shocks caused by the different sealing steps.

The step of opening out and partly rotating the top end of the filter bag before definitively closing it, besides being extremely critical and strongly dependent on the rigidity of the filter material, causes elasto-plastic torsion of the filter material, with the risk of damaging or crushing the product contained therein (granules or leaves), thereby reducing the end quality of the product.

The large number of steps required to form filter bags of this shape also necessitates, as may be inferred from the above, a large number of stations which, in practice, means that the machines used to make them are complex and expensive.

Moreover, the large number of stations also makes the productivity of the machines per unit time relatively low, especially if compared to those used to make traditional filter bags.

The different stations used for sealing at different times (and requiring the filter bag to be manipulated in different ways) also means that the sealing operations must be extremely precise.

In light of this, the filter bags are often imperfect in appearance.

Another type of machine for making tetrahedral filter bags is known from international patent application WO 95/01907, which describes a machine having what is known as a vertical-axis tie around which a strip of filter paper is wound to form a closed tube, a doser by which a dose of product is dosed into the closed tube and two wheel-like sealing elements positioned at 90° to each other about a vertical axis. These sealing elements make seals on the closed tube of filter paper which are in turn at 90° to each other about the vertical axis of the tie to form a filter bag of tetrahedral shape.

DISCLOSURE OF THE INVENTION

The aim of this invention is to provide a machine for making filter bags from thermoformable filter material for infusion products which overcomes the above mentioned disadvantages of the prior art and provides an alternative to prior art machines.

Another aim is to provide a machine for making filter bags from thermoformable filter material for infusion products which can produce three-dimensional filter bags of high quality and which offers high productivity per unit time and good operating flexibility.

Another aim of the invention is to provide a filter bag for infusion products of high quality and attractive appearance.

These aims are fully achieved by the machine and filter bag forming the object of this invention and as characterized in the appended claims.

According to the invention the machine for making filter bags for infusion products formed from lengths of filter material comprises at least a station for feeding a first continuous strip of thermoformable filter material movable along a working path.

Also according to the invention, the machine comprises a station for preparing for hot plastic deformation of the first continuous strip located along the working path of the first continuous strip itself.

Also according to the invention, the machine comprises a drum, disposed downstream of the heating station along the working path, for forming a first portion of the filter bag. The drum has two mutually concentric circular parts continuously rotating in phase about a single axis so as to configure an annular zone where the first continuous strip is interposed. A first circular part of the drum is provided with a series of radial dies, and a second part has a corresponding series of forming punches for forming the first strip of filter material and adapted to plastically deform a portion of the first strip of filter material inside a corresponding die for a predetermined arcuate stretch of the circular path followed by the drum, so as to form an open three-dimensional chamber of filter material.

Also according to the invention, the machine comprises a station for feeding a dose of infusion product and configured for placing, the dose, in phase, inside the open three-dimensional chamber of filter material housed in the corresponding die of the drum.

Also according to the invention, the machine comprises a station for feeding a second strip of filter material and configured for placing the second strip above the first strip with the three-dimensional chambers with the dose of product, so as to define a second part, or flat base, that closes the filter bag.

Again according to the invention, the machine comprises a station for joining/closing the second strip of filter material onto the first strip of filter material and located along the working path, downstream of the station for feeding the second strip of filter material.

The machine structured in this way allows high productivity of high-quality three-dimensional filter bags thanks to the combination of closely spaced working stations and the possibility of forming the filter bag from only two parts of filter material and a single seal for sealing the two parts to each other. Furthermore, the machine according to the invention reduces the consumption of filter material because the filter material is deformed by elongation and the dies (and respective punches) are spaced close to each other.

The invention also provides a filter bag for infusion products in powder, granular, or leaf form, comprising: a first portion of filter material, thermoformed and defining a three-dimensional chamber for containing a dose of infusion product and having an opening with an external, continuous, perimeter edge; a second portion of filter material, flat and adapted to close the three-dimensional chamber of the first portion; the second portion of filter material is larger in size than the opening of the first portion and is joined to the first portion at the external, continuous, perimeter edge projecting from the three-dimensional product containment chamber.

Preferably, the external, continuous, perimeter edge of the first portion of filter material lies in the same plane as the remaining part of the second portion to define a flat base.

Ultrasound sealing and cutting systems can be used to reduce the width of the external, continuous, perimeter edge.

BRIEF DESCRIPTION OF THE DRAWINGS

These and other features of the invention will become more apparent from the following detailed description of a preferred, non-limiting embodiment of it, with reference to the accompanying drawings, in which.

DETAILED DESCRIPTION OF PREFERRED EMBODIMENTS OF THE INVENTION

Figure 1:
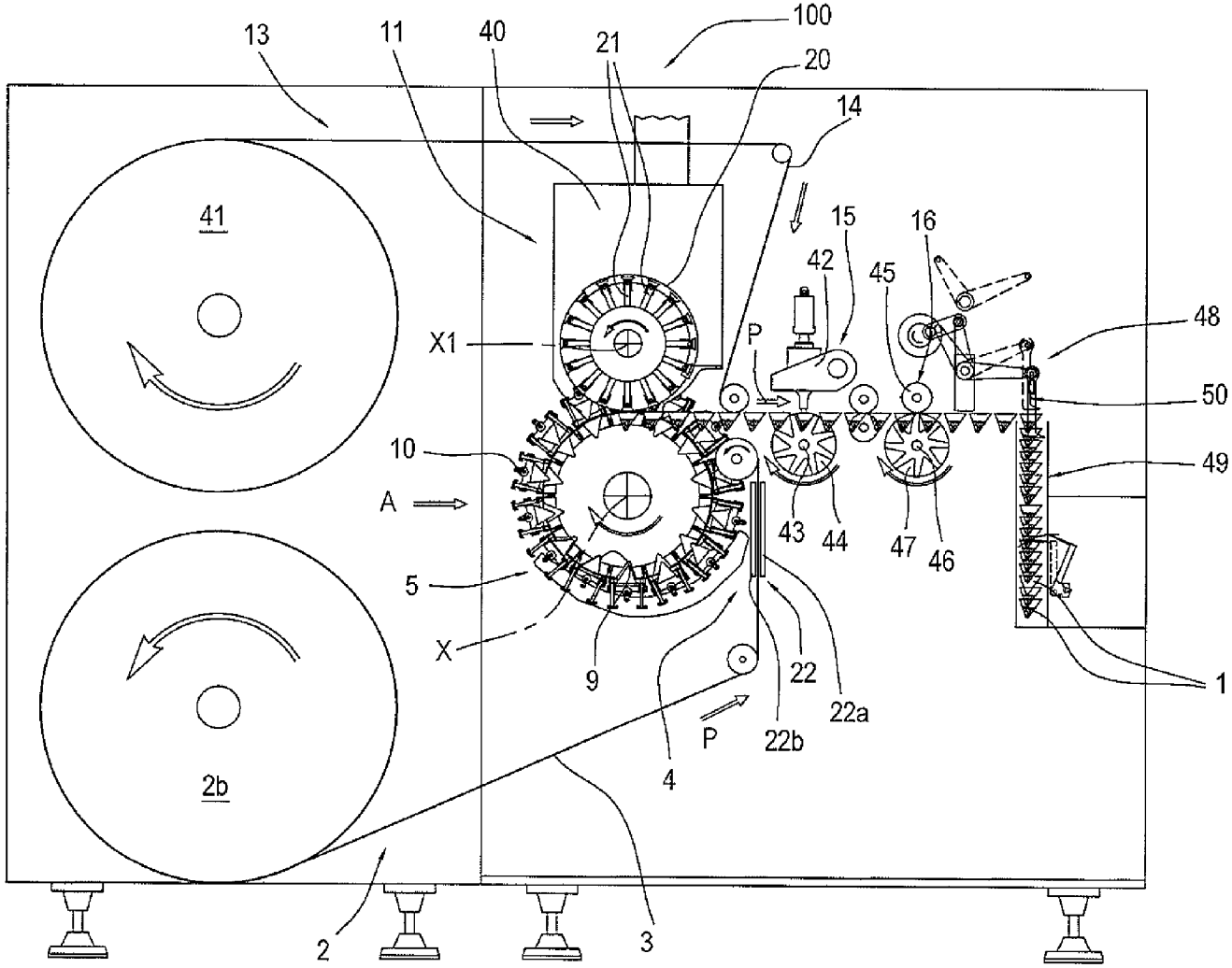
FIG. 1 is a schematic front view, with some parts cut away to better illustrate others, of a machine for making filter bags for infusion products according to this invention.

With reference to the accompanying drawings, in particular FIGS. 1 and from 5 to 7, the machine of this invention, denoted by the numeral 100 is used for making filter bags, or tea bags 1 for infusion products such as tea, coffee, chamomile, and the like.

Preferably, the infusion products contained in the filter bags 1 may be coarse-sized products as, for example, powder, granules or leaves.

More specifically, the filter bags 1 made in the machine of the invention are formed from lengths of filter material, of which at least one is plastically deformable by heat, that is, thermoformable.

According to the invention (see FIGS. 1 and 2) the machine 100 for making filter bags 1 for infusion products formed from lengths of filter material comprises at least a station 2 for feeding a first continuous strip 3 of thermoformable filter material movable along a working path P.

According to the invention, the machine 100 comprises a station 4 for heating, or preparing for the hot plastic deformation of, the first continuous strip 3, this station being located along the working path P of the first continuous strip 3 itself.

Also according to the invention, the machine 100 comprises a drum 5 for forming a first portion of the filter bag 1.

The drum 5 for forming a first portion of the filter bag 1 is disposed downstream of the station 4 for heating along the working path P.

Also according to the invention, the drum 5 has two mutually concentric circular parts 6 and 7 (clearly shown in FIG. 4) continuously rotating in phase about a single axis X so as to configure an annular zone 8 where the first continuous strip 3 is interposed.

The first circular part 6 of the drum 5 is equipped with a series of radial dies 9.

The second part 7 of the drum 5 is equipped with a corresponding series of forming punches 10 for forming the first strip 3 of filter material and adapted to plastically deform a portion of the first strip 3 of filter material inside the corresponding die 9 at least for a predetermined arcuate stretch T of the circular path followed by the drum 5, so as to form an open three-dimensional chamber C of filter material, which has an opening 23 of desired shape, for example triangular, square, polygonal or circular.

The forming punches 10 cannot be heated; alternatively, the forming punches 10 may be heated, for example by means of thermo-resistors. Also according to the invention, the machine 100 comprises a station 11 for dosing a dose 12 of infusion product and configured for placing, the dose 12, in phase, inside the open three-dimensional chamber C of filter material housed in the corresponding die 9 of the drum 5.

Also according to the invention, the machine 100 comprises a station 13 for feeding a second strip 14 of filter material and configured for placing the second strip 14 above the first strip 3 with the three-dimensional chambers 10 with the dose 12 of product, so as to define a second part, or flat base that closes the filter bag 1.

Again according to the invention, the machine 100 comprises a station 15 for joining/closing the second strip 14 of filter material onto the first strip 3 of filter material and located along the working path P, downstream of the station 13 for feeding the second strip 14 of filter material.

The machine 100 also comprises a cutting station 16 for making a sequence of single, flat-based filter bags 1 by cutting the first continuous strip 3 and the second continuous strip 14 of filter material.

In light of this, the cutting station 16 is located downstream of the joining/closing station 15 along the working path P.

Preferably, but not necessarily, the station 4 for preparing the first strip 3 of filter material comprises means 22 for heating to a predetermined temperature the first strip 3 of filter material in transit.

Again preferably, but not necessarily, the preparing station 4 is located upstream of the forming drum 5 relative to the direction of feed of the first continuous strip 3 of filter material along the working path P.

In light of this, the heating means 22 may comprise a pair of heated plates 22*a* and 22*b*.

The two plates 22*a* and 22*b* are placed face to face to form a channel through which the first strip 3 of filter material can pass.

It should be noted that the temperature and size of the plates 22*a*, 22*b* are functions of the temperature which the filter material must reach in order to be formed in the forming drum 5 and of the speed at which the filter material moves in the channel formed by the plates 22*a* and 22*b*.

Preferably, the first strip 3 of filter material is heated to a temperature of between 100° and 180°, more preferably between 100° and 140°.

Preferably, the two plates 22*a* and 22*b* are located next to the forming drum 5 by which the first strip 3 of filter material is formed.

Alternatively, or in addition, to the heated plates 22*a* and 22*b*, the heating means 22 may include hot air generators, designed to blow hot air towards the first strip 3 of filter material, or UV lamps, adapted to radiate the first strip 3 of filter material.

Alternatively, the preparing station 4 may comprise the selfsame drum 5 where the first and second circular parts 6 and 7 (that is, dies and punches) are equipped with heating means (not illustrated) for preparing the first continuous strip 3 of filter material for thermoforming.

The drum 5 may be equipped with heating means (not illustrated) also in combination with the thermoforming preparing station 4 comprising the above mentioned heating means 22 and located upstream of the drum 5 itself.

Preferably, the station 2 for feeding the first continuous strip 3 of thermoformable filter material movable along a working path P comprises a roll 2*b* of continuous strip of filter material.

The drum 5 comprises a circular surface defining the first circular part 6 provided with the dies 9. Purely by way of non-limiting example, the dies 9 have a triangular base (see FIGS. 1, 2 and 4).

In this light, the first circular portion 6 of the drum 5 is the inner part of the drum itself and each die 9 develops radially towards the center of the drum 5.

In this light, each die 9 is formed on the outer surface of the first circular portion 6 and penetrates inside the drum 5 toward the center of the same drum 5.

In short, each die 9 has a cavity whose cross section is triangular in shape, which can house a portion of the first strip 3 of filter material and which can slidably receive a matching punch 10 with a matchingly shaped triangular base.

Each punch 10 is movable radially to and from the corresponding die 9 to form the three-dimensional chamber C.

Again by way of example, the dies 9 are arranged in juxtaposed pairs on the circular surface 6 according to a head/tail orientation along the axis of rotation X, in order to limit overall dimensions.

It should be noted that the drum 5 is connected at the back to a cylindrical drive support 25 (continuous rotation) having, formed thereon or fitted thereto, cam means for activating or deactivating the punches 10.

The punches 10 are arranged in circular crown fashion around the circular surface of the first part 6 of the drum 5.

Each punch 10 is placed face to face with a corresponding die 9 present on the first circular part 6 of the drum 5.

In light of this, the second circular part 7 of the drum comprises a series of punch units 10 each composed of a pair of juxtaposed punches 10 arranged according to a head/tail orientation along the axis of rotation X, facing a respective pair of dies 9.

Alternatively, the dies 9 (and the corresponding punches 10) may be provided in a different number from that illustrated, as a function of required machine productivity and overall dimensions allowed.

Preferably, the second part 7 defines the circular outer part of the drum 5 and is formed by the crown of the punches 10. Each punch 10 moves radially toward the center of the drum 5 to form the three-dimensional chamber C.

Preferably, the machine 100 includes retaining means 17 for retaining the first continuous strip 3 of filter material, located between the first circular part 6 and the second circular part 7 of the drum 5, and acting on stretches of the first strip 3 of filter material located on opposing sides of each die 9 in phase with the corresponding punch 10 during the step of plastically deforming the first strip 3 of filter material. In other words, the retaining means 17 block, relative to the dies 9, the stretches of the first strip 3 of filter material which are not thermoformed.

Preferably, the retaining means 17 for blocking the first strip of filter material are connected to each punch unit 10.

In light of this, the retaining means 17 comprise a head presser 26 for each punch 10. The presser 26 is substantially parallel to the surface of the first circular part 6 of the drum 5.

The head presser 26 is configured to retain portions of the first strip 3 of filter material around each die 9 without interfering with the corresponding punch 10.

Figure 4:
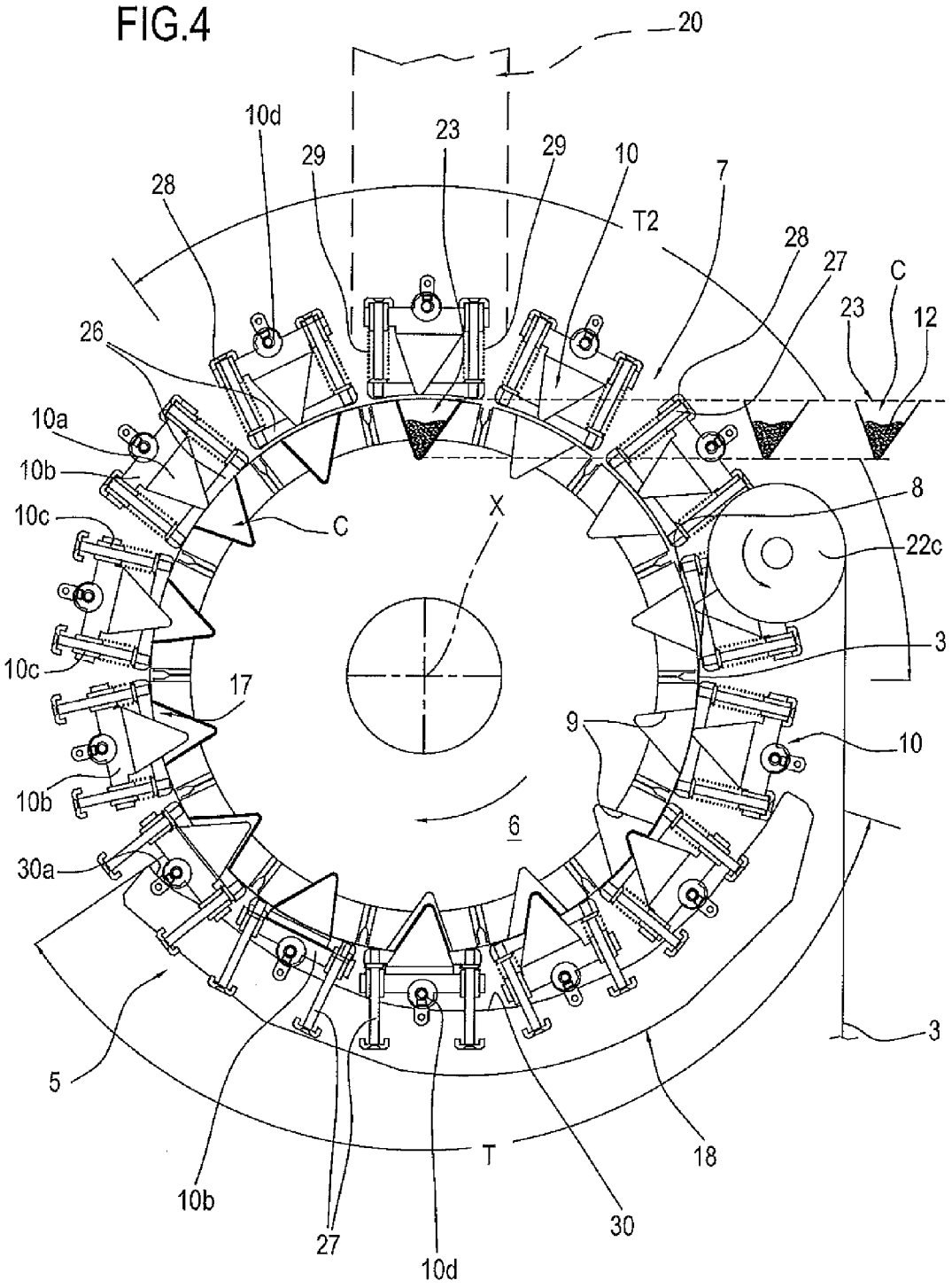
FIG. 4 is a scaled-up front view of the forming drum of FIGS. 1 and 2.

Each head presser 26 is supported by a frame comprising at least one pair of columns 27 arranged radially relative to the surface of the first circular part 6 of the drum 5 without interfering with the movement of the punch 10 (see FIG. 4 in particular).

In light of this, the two columns 27 are connected, at a first end, to the head presser 26.

At a second end of them, the two columns 27 are connected to corresponding hold-down end pieces 28.

Figure 2:
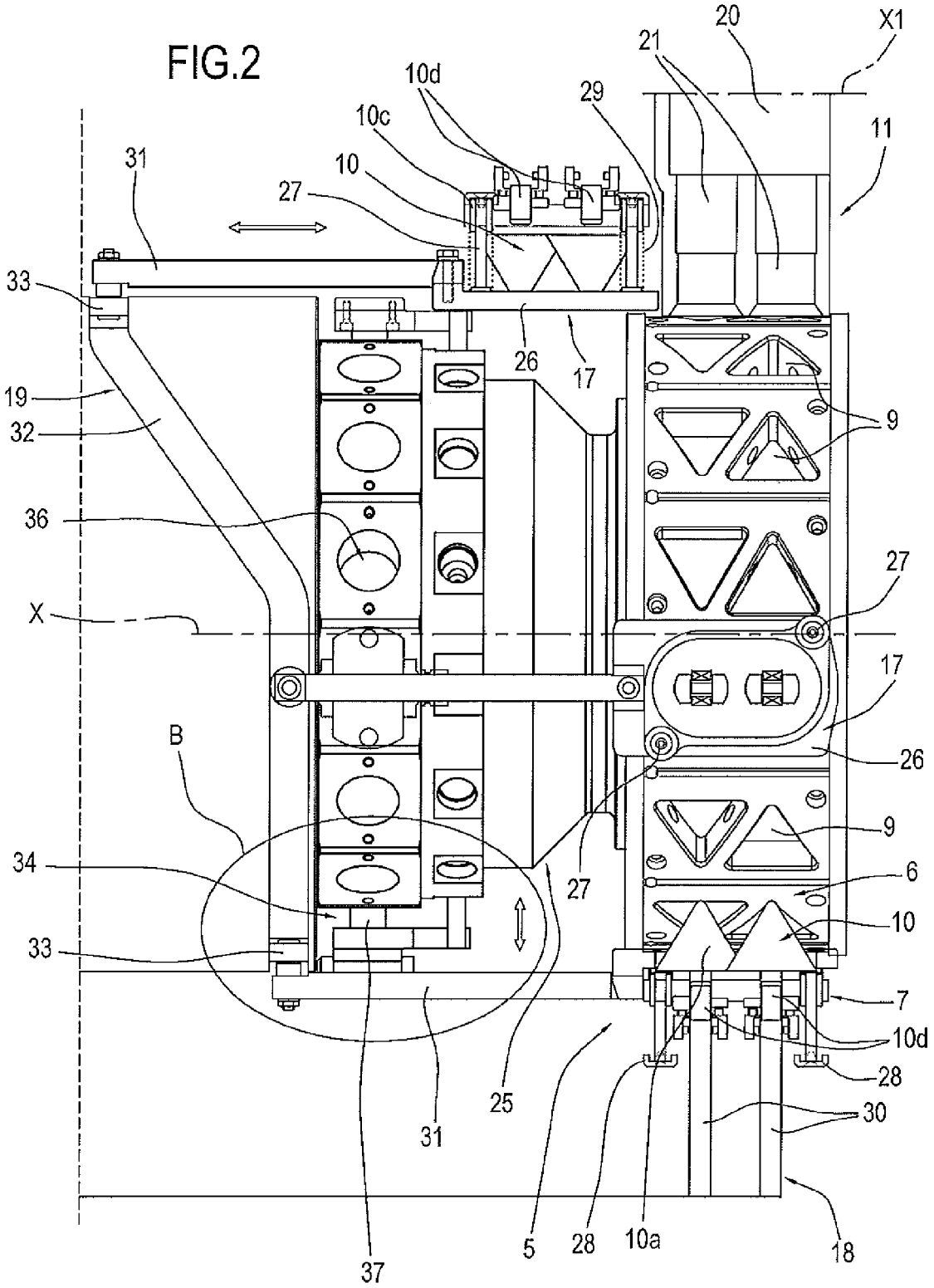
FIG. 2 illustrates a part of the machine of FIG. 1, in particular a forming drum and a dosing station, in a side view from side A in FIG. 1 and with some parts cut away in order to better illustrate others.

Preferably, the two columns 27 are offset along a diagonal (referred to the shape of the presser 26 which, in this case, is the shape of a ring, see FIG. 2) to balance the movements of the punch 10.

Alternatively, the frame may comprise at least four columns 27 connected to the presser 26 to further improve the hold and strength of the presser 26 and the movement of the punch 10 (structure not illustrated here).

Preferably, the punch 10 comprises an operating head 10*a* shaped to match the underlying die 9 and an upper supporting member 10*b* provided with cylinders 10*c* which are slidably coupled in the columns 27 of the frame.

In light of this, each column 27 has fitted around it a spring 29 which is interposed, at the ends of it, between the head presser 26 and the corresponding cylinder 10*c* of the punch 10.

It should be noted that the springs 29 are configured to keep the punch 10 at an idle position, away from the die 9.

Preferably, the machine 100 comprises cam means 18 for activating and deactivating the punches 10, acting on the second circular part 7 of the drum 5 equipped with the selfsame punches 10, and configured for radially moving the punches 10, at least along the arcuate stretch T, between an inoperative position, where the punch 10 is positioned away from the die 9 and from the first strip 3, and an operative position, where the punch 10 is engaged with the die 9 so as to plastically deform the first strip 3.

In light of this, the cam means 18 comprise an arcuate cam profile 30 located along the circular path followed by the punches 10 (in this case, clockwise, as indicated by the arrow in FIG. 4).

The cam profile 30, which is located downstream of the zone where the first strip 3 of filter material is fed, extends along an arc whose length varies as a function of the type of filter material used, the temperature at which the selfsame filter material is fed on the drum 5, the shape of the punch 10 and die 9, and so on.

In light of this, the first continuous strip 3 of filter material is fed by means of an idle roller 22*c* into a zone of the drum 5 interposed between a zone where the doses 12 are fed and a zone where the punches 10 are activated.

It should be noted that the cam profile 30 is intercepted by cam follower rollers 10*d* located on each supporting member 10*c* of the punches 10.

The cam profile 30 is configured, in shape, to obtain a radial movement by which the punch 10 moves towards and engages the die 9 in the arcuate stretch T in order to plastically deform the portion of the first strip 3 of filter material inside the die 9, giving it the end shape of a filter bag 1.

An end portion 30*a* of the cam profile 30 causes an initial movement of the punch 10 away from the die 9, with the aid of the above mentioned springs 29 interposed between the presser 26 and the cylinders 10*c* of the punch 10.

In effect, during the radial downstroke, the springs 29 are compressed along the cylinders 10*c*, whilst at the end of the feed stretch T, the punches 10 are disengaged from the cam profile 30 and the springs 29 are free to take the punch 10 back to the inoperative position, that is to say, away from the die 9.

In an alternative embodiment not illustrated, the punches 10 may be provided with, or connected to, further cam follower elements adapted to engage a further cam profile to assist the springs 29 to move the punches 10 away from the corresponding die 9 towards the inoperative position. Preferably, the drum 5 has means 19 for moving each punch 10, in both directions, parallel to the axis X of rotation of the selfsame drum 5 so as to move the punches 10 away from the dies 9 for a predetermined second stretch T2 of arcuate path covered by the selfsame punches 10 in proximity of the station 11 for feeding a dose 12 of product and vice versa. In light of this, the means 19 comprise a supporting arm 31 for each pair of punches 10 (and corresponding head presser 28) extending parallel to the axis of rotation X and connected at its free end to a cam profile 32 formed on the cylindrical support 25 behind the drum 5.

Each arm 31 is provided with a cam follower roller 33 coupled to the cam profile 32.

The cam profile 32 defines a path configured to withdraw the punch 10 along the stretch T2 of the path of the punch 10 before the dies 9 arrive under the product dosing station 11.

It should be noted that the movement means 19 keep each punch 10 in the withdrawn position even at the zone for feeding the first strip 3 of filter material so as not to interfere with the positioning of the first strip 3 on the surface of the first circular part 6.

In light of this, the movement means 19 cause the punches 10 to make a movement in the opposite direction, that is, a feed movement, immediately after passing the zone of entry of the first strip 3 of filter material on the surface of the first circular part 6 of the drum 5.

The machine 100 also comprises further means 34 for radially adjusting the head presser 26 relative to the surface of the first circular part 6 of the drum 5.

These adjustment means 34 are combined with the means 19 for moving (axially) each group of punches 10, which in the case illustrated form a pair of punches 10.

Figure 3:
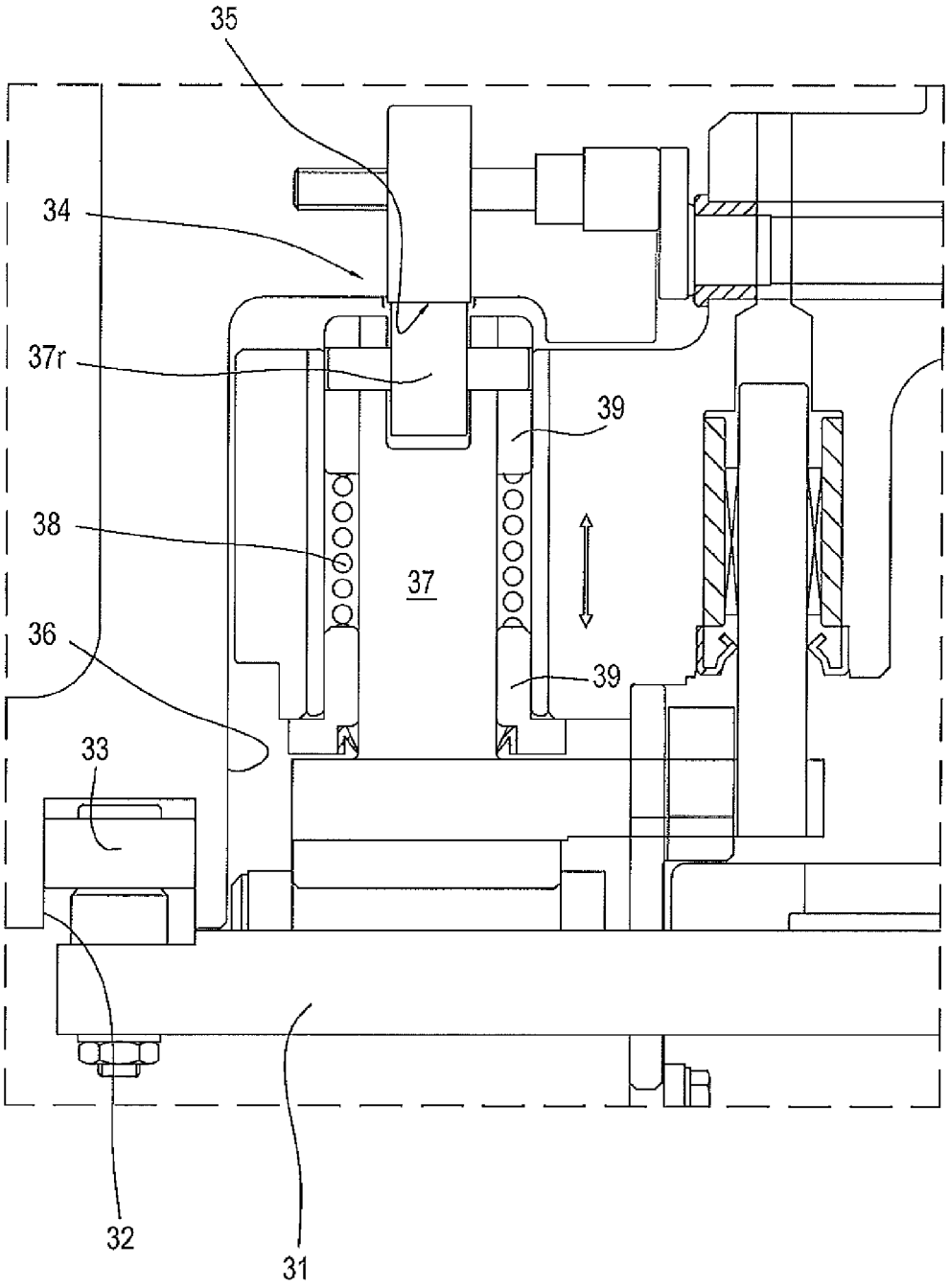
FIG. 3 shows an enlarged detail B from FIG. 2.

In light of this, the adjustment means 34 comprise an arcuate cam profile 35 fixedly disposed inside the cylindrical support 25 (see FIG. 3) and acting on each arm 31 of each group of punches 10

It should be noted that the cylindrical support 25 has a series of radial cavities 36 for receiving a corresponding shaft 37 connected to the supporting arm 31.

The shaft 37 projects radially outside the corresponding cavity 36 for connection to the arm 31 and, at the opposite end, also projects out of the cavity 36 formed on the cylindrical support 25.

To the inner end of the shaft 37 there is connected a cam follower roller 37*r* for contact with the arcuate cam profile 35.

Each cavity 36 also houses a spring 38 fitted axially round the shaft 37 and held at the ends of it by opposing covers 39.

The charge of each spring 38 tends (by means of the arm 31) to keep the presser 26 normally opposed to the first strip 3 of filter material with a predetermined force.

Contact between the cam follower profile 37*r* with the cam profile 35 allows compressing the spring 38 and stopping the first strip 3 on the first circular part 6 of the drum 5.

The cam profile 35 is configured to overcome the compressive force of the spring 38 until moving the shaft 37 radially relative to the surface of the first circular part 6 of the drum 5 and moving the presser 26 away from the selfsame surface of the first circular part 6 of the drum 5.

It should be noted that this arcuate stretch of the cam profile 35 is at least substantially equal to the length of the stretch T2 acted upon by the means 19 for moving the punches 10 backwards/forwards.

Preferably, this arcuate stretch of the cam profile 35 is above the stretch T2 so as to prevent scraping between the surfaces of the presser 26 and of the first strip 3 of filter material during the backward/forward movement. Preferably, the station 11 for dosing a product dose 12 comprises a further drum 20 which rotates about an axis X1 parallel to the axis of rotation X of the forming drum 5.

The further drum 20 is configured for bringing, in phase, a dosing chamber 21 above a corresponding three-dimensional chamber C of filter material formed and positioned inside a corresponding die 9.

In light of this, the further drum 20 is positioned above the first drum 5 and comprises a plurality of radially equispaced dosing chambers 21.

Each dosing chamber 21 is gravity fed with product from a hopper 40 located above the further drum 20 and, after rotating through approximately 180°, the dosing chamber 21 discharges the product dose 12 into the three-dimensional chamber C inside the corresponding die 9. Advantageously, the dosing station 11 doses coarse sized products such as, for example, infusion products in powder, granular or leaf form.

In an alternative embodiment, not illustrated, the further drum 20 may be located further upstream, or further downstream, along the working path P than illustrated in FIG. 1. More specifically, the further drum 20 may be located at a stretch where the chamber C is partly outside the corresponding die 9, or in a stretch where the chamber C is totally outside the corresponding die 9, for example in a stretch where the first strip 3 of filter material is horizontal immediately upstream and immediately downstream of the further drum 20.

Preferably, the station 13 for feeding the second continuous strip 14 of filter material comprises a second roll 41 of filter material and a series of idler wheels configured to carry the second strip 14 above the first strip 3 of filter material formed with the three-dimensional chamber C filled with the product dose 12.

Preferably, the joining/closing station 15 comprises a sealing unit 42 located above the two juxtaposed strips 3, 14.

The sealing unit 42 is configured to join the second strip 14 to the first strip 3 (for example by heat or ultrasound sealing).

In light of this, the sealing unit 42 comprises a sealing head configured to join the second strip at least along the opening 23 of the three-dimensional chamber C.

Preferably, the sealing unit 42 can create a seal between the first and the second strips 3, 14 at a joining zone along the opening 23 such as to form a perimeter edge projecting from the product containing chamber C. Preferably, the joining/closing station 15 comprises an opposing cylinder 43 located below the two strips 3, 14 of filter material and the sealing unit 42. The cylinder 43 rotates about a horizontal axis and is in phase with the sealing unit 42.

The cylinder 43 comprises matching cavities 44 for receiving the three-dimensional chamber C which are radially equispaced in such a way as to form an opposing surface for the sealing unit 42.

Preferably, the cutting station 16 comprises a rotary knife 45 and an opposing cylinder 46 located downstream of the joining station 15 relative to the working path P.

In light of this, the rotary knife 45 (located above the first strip 3 and the second strip 14) is configured to cut and separate at least partly, and preferably completely, lengths 3P defining the three-dimensional chamber C from the first strip 3 and lengths 14P defining a flat base for closing the opening 23 of the three-dimensional chamber C from the second strip 14 according to a desired perimeter shape, (triangular, quadrangular, or other shape). The knife 45 rotates continuously about a respective horizontal axis.

Preferably, the rotary knife 45 separates the filter bag 1 from the strips 3, 14, in such a way as to form on the filter bag 1 an edge which is larger in size than the opening 23 of the three-dimensional chamber C.

The opposing cylinder 46 (located under the line of feed of the two strips 3 and 14) comprises a plurality of matching cavities 47 for receiving the three-dimensional chamber C of the filter bag 1 so as to form an opposing surface while the filter bag 1 is being cut.

The cylinder 46 rotates continuously about a horizontal axis and is in phase with the knife 45.

Preferably, downstream of the cutting station 16 there is a station 48 for separating the filter bags 1 from the waste offcuts and stacking the filter bags 1 along a stacking channel 49, preferably with a vertical axis.

In light of this, the separating and stacking station 48 comprises a pusher element 50 located above the line of transit of the strips 3 and 14 of filter material and adapted to definitively separate the filter bag 1 from the remaining continuous strip of waste offcuts along a trajectory transversal to the line of feed of the selfsame strip.

The pusher element 50 then pushes the finished filter bag 1 into the vertical stacking channel 49.

The invention also provides a filter bag 1 for infusion products as, for example, coarse-sized products in powder, granular or leaf form.

Figure 5:
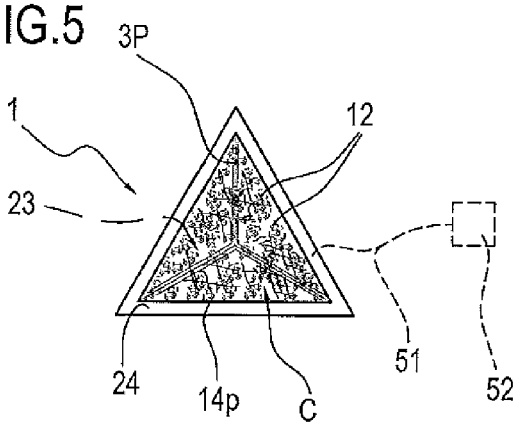
FIG. 5 is a perspective view of a tetrahedral thermoformed filter bag according to the invention, made with the machine of the preceding figures.
Figure 6:
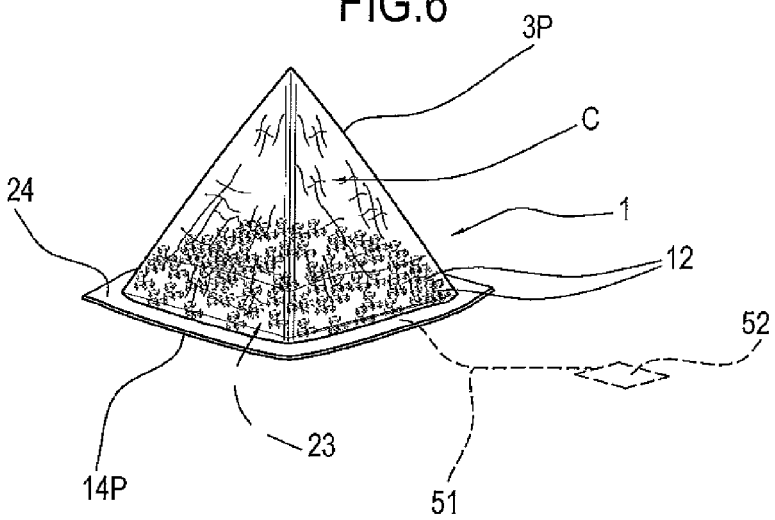
FIGS. 6 and 7 are a perspective view and a top plan view, respectively, showing a variant embodiment of the filter bag of FIG. 5 with a square based pyramid shape.
Figure 7:
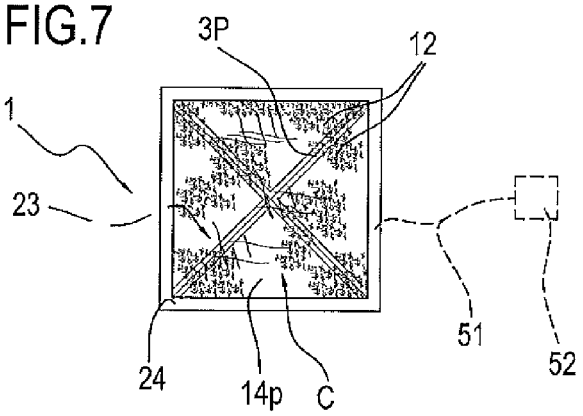

According to the invention, the filter bag, or tea bag, 1 (see FIGS. 5 to 7) comprises a first portion 3P of filter material, thermoformed and defining a three-dimensional chamber C for containing a dose 12 of infusion product and having an opening 23 with an external, continuous, perimeter edge 24.

Also according to the invention, the filter bag 1 comprises a second portion 14P of filter material, flat and adapted to close the three-dimensional chamber C of the first portion 3P.

The second portion 14P of filter material is larger in size than the opening 23 of the three-dimensional chamber C.

The second portion 14P is joined to the first portion 3P at the external, continuous, perimeter edge 24 projecting from the three-dimensional product containment chamber C.

Preferably, the external, continuous, perimeter edge 24 of the first portion 3P of filter material lies in the same plane as the remaining part of the second portion 14P to define a flat base.

Preferably, the first portion 3P of filter material has three triangular surfaces which, together with the second flat portion 14P of filter material, form a tetrahedral shape with the external, continuous, perimeter edge 24 projecting externally from each side defined by the first portion 3P of thermoformed filter material.

Alternatively, the first portion 3P of filter material has four triangular surfaces which, together with the second flat portion 14P of filter material, form a square based pyramid shape with the external, continuous, perimeter edge 24 projecting externally from each side defined by the first portion 3P of thermoformed filter material.

Preferably, the projecting sides of the flat edge 24 form a convenient surface for attaching a string 51 for connection to a tag 52 used for handling during infusion of the product contained in the filter bag 1.

Preferably, the flat external surface defined by the second portion 14P forms a convenient surface for neatly associating the string 51 and tag 52 when in the inoperative packaged position of the filter bag 1.

In alternative embodiments not illustrated, the punches 10 may differ in shape from those illustrated: for example, they may have four or more flat polygonal surfaces or curved surfaces. Also, the punches 10 might have a polygonal or circular base to form filter bags 1 of different shapes alternative to those illustrated, for example the shape of a cube, a cylinder, a pyramid, a cone, a parallelepiped, a sphere, a hemisphere, or other shape.

The machine structured as described herein fully achieves the preset aims and offers appreciable advantages in terms of end product quality and production speed per unit time.

In particular, the machine has the following advantages:

- good sealing strength of the filter bag because there is only one seal, which is a seal is made in one plane on a single part of the filter material, without seals made on top of one another;
- the infusion product is protected from damage in that it is fed into the three-dimensional chamber after the chamber has been formed and undergoes no further manipulation;
- the infusion product dose always remains in a zone which is clear of the operations by which the filter bag is sealed, cut or otherwise manipulated;
- the number of operating stations is reduced compared to the traditional prior art machine since the three-dimensional chamber is formed by a single drum from a flat strip of filter material;
- the reduced number of operating stations allows continuous machine movement while maintaining a high level of precision in forming the filter bag;
- a single sealing step means the filter bag undergoes less manipulation and makes it possible to obtain precise, and very good quality/strong seals.

In light of this, it is possible to obtain high quality filter bags.

Thanks to the special shape of the sealed edge, flat projecting sides are formed which, on the one hand, guarantee the strength of the filter bag and, on the other, offer a convenient space for the application of product data without modifying the features of the filter bag itself.

The invention claimed is:

1. A machine for making filter bags (1) for infusion products formed from lengths of filter material,
characterized in that it comprises at least:

- a station (2) for feeding a first continuous strip (3) of thermoformable filter material movable along a working path (P);
- a station (4) for heating the first continuous strip (3) of filter material, located along the working path (P) and including means (22) for heating the first continuous strip (3) of filter material at a predetermined temperature;
- a drum (5) for forming a first portion (3P) of the filter bags (1) disposed downstream of the station (4) for heating along the working path (P); said drum (5) having three mutually concentric circular parts (6, 7, 19) continuously rotating in phase about a single axis (X) of rotation; a first circular part (6) of the drum (5) being provided with a series of radial dies (9), and a second part (7) having a corresponding series of forming punches (10) for forming the first strip (3) of filter material and adapted to plastically deform a portion of the first strip (3) of filter material inside a corresponding die (9) at least for a predetermined arcuate stretch (T) of a circular path followed by the drum (5), so as to form an open three-dimensional chamber (C) of filter material and a third part (19) for moving each punch in opposing directions;
- a station (11) for dosing a dose (12) of infusion product and configured for placing, the dose (12), in phase with the drum (5), inside the open three-dimensional chamber (C) of filter material;
- a station (13) for feeding a second continuous strip (14) of filter material and configured for placing the second continuous strip (14) above the first continuous strip (3) of filter material with the three-dimensional chambers (C) with the dose (12) of infusion product, so as to define a flat base that closes the filter bags (1);
- a station (15) for joining/closing the second continuous strip (14) of filter material onto the first continuous strip (3) of filter material and located along the working path (P), downstream of the station (13) for feeding the second continuous strip (14) of filter material;
- a cutting station (16) for making a sequence of single, flat-based filter bags (1) by cutting the first and the second continuous strip (3, 14) of filter material; the cutting station (16) being located downstream of the joining/closing station (15) along said working path (P).

2. The machine according to claim 1, including retaining means (17) for retaining the first continuous strip (3) of filter material, located between the first circular part (6) and the second circular part (7) of the drum (5), and acting on stretches of the first continuous strip (3) of filter material located on opposing sides of each die (9) in phase with a corresponding punch (10) during a step of plastically deforming the first continuous strip (3) of filter material, said retaining means (17) being adapted to block said stretches of the first of filter material with respect to the dies (9).

3. The machine according to claim 1, including cam means (18) for activating and deactivating the punches (10) and configured for radially moving the punches (10), at least along said arcuate stretch (T), between an inoperative position, where the punch (10) is positioned away from the die (9) and from the first continuous strip (3), and an operative position, where the punch (10) is coupled to the die (9) so as to plastically deform the first continuous strip (3).

4. The machine according to claim 1, wherein said third part (19) moves each punch (10), in opposing directions, parallel to the axis (X) of rotation of the selfsame drum (5) so as to move the punches (10) away from the dies (9) for a predetermined second stretch (T2) of arcuate path followed by the selfsame punches (10) in proximity of the station (11) for dosing a dose (12) of infusion product.

5. The machine according to claim 1, wherein the station (11) for dosing a dose (12) of infusion product includes a further drum (20) rotating about an axis (X1) parallel to the axis (X) of rotation of the drum (5) and configured for bringing, in phase with the drum (5), a dosing chamber (21) above a corresponding three-dimensional chamber (C) of filter material formed and positioned inside a corresponding die (9).

* * * * *